US006173470B1

(12) United States Patent
van Osenbruggen

(10) Patent No.: US 6,173,470 B1
(45) Date of Patent: Jan. 16, 2001

(54) BRUSH ATTACHMENT FOR GRINDER

(75) Inventor: Anthony Alfred van Osenbruggen, Auckland (NZ)

(73) Assignee: Norton Company, Worcester, MA (US)

( * ) Notice: Under 35 U.S.C. 154(b), the term of this patent shall be extended for 0 days.

(21) Appl. No.: 09/001,753

(22) Filed: Dec. 31, 1997

(30) Foreign Application Priority Data

Jan. 6, 1997 (NZ) ..... 314024

(51) Int. Cl.[7] ..... A47L 11/00

(52) U.S. Cl. ..... 15/180; 15/179; 451/508; 451/521

(58) Field of Search ..... 15/179, 180, 182, 15/200, 87, 28, 29; 451/532, 496, 508, 510, 521

(56) References Cited

U.S. PATENT DOCUMENTS 1,497,921 * 6/1924 Levedahl .
1,564,226 * 12/1925 Finnel .
1,606,821 * 11/1926 Anderson .
2,153,207 * 4/1939 Petty ..... 15/50.1
2,480,877 * 9/1949 Peterson ..... 15/180
2,930,056 * 3/1960 Lappin .
4,771,498 * 9/1988 Torta ..... 15/180

FOREIGN PATENT DOCUMENTS

21648 * 2/1978 (JP) ..... 15/180

* cited by examiner

*Primary Examiner*—Gary K. Graham
(74) *Attorney, Agent, or Firm*—David Bennett

(57) ABSTRACT

The invention provides a wire brush disc shaped grinder accessory that has segments removed from the circumference of the disc to provide visibility of the work surface while in use and with the bristles of the wire brush arranged in groups around the disc. It also provides a cup shaped wire brush tool wherein the bristles are arranged in groups. In this way both provide a cooler cutting action.

11 Claims, 5 Drawing Sheets

BRUSH ATTACHMENT FOR GRINDER

TECHNICAL FIELD OF THE INVENTION

Figure 1:
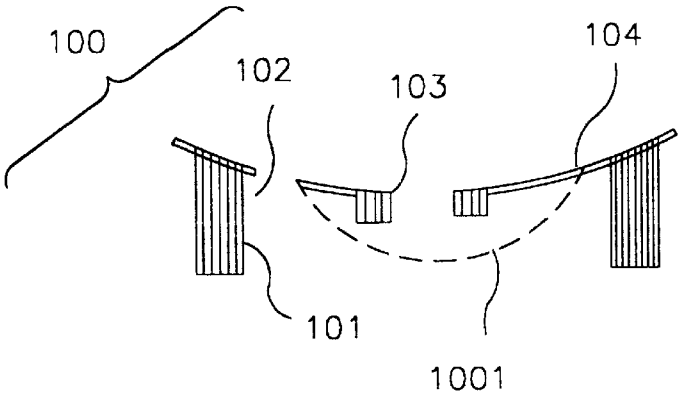

This invention relates to the field of rotatable tools of the type having projecting bristles such as wire brushes intended for surface cleaning and to some extent shaping purposes, optionally also having manufactured edges or teeth, for shaping and forming materials. In particular this invention relates to brushes characterized by the way—and positions—at which the bristles are fixed or joined in or on the brush body or carrier and the shape of the carrier.

BACKGROUND

Grinders such angle grinders equipped with wire brush-like spinning attachments are widely used in trade for the removal of paint, rust, and other coatings from engineering structures, vehicles, ships, and the like. Wire brush attachments have some disadvantages, such as providing a greater torque on the spinning angle grinder than the torque from an abrasive disk. The tools described in this specification are developments of tools suitable for use with grinders as described in our earlier patent applications such as PCT/NZ95/00035 and PCT/US96/16511, the contents of which are incorporated by way of reference. The tools described therein provide advantages over prior-art tools, the advantages including better control of the "bite" by varying the angle of attack; the tool having a non-cutting rest surface (which may spin), also visibility of the work surface at or about the cutting edge, and forced cooling of the work surface.

STATEMENT OF THE INVENTION

The invention comprises an accessory for a grinder comprising a rotatable disc-shaped tool having a first surface and a second surface, an axis of rotation and being adapted to be mounted on an arbor of an angle grinder and being provided with a working zone extending inwardly from the perimeter of the tool; and the working zone of the rotatable tool is provided with a plurality of brush-like bristles, wherein the bristles are mounted to project outwards from a surface in two or more spaced-apart groups around the working zone, and the edge of the disc in the portions of the disc between the groups is modified by removal of segments of the body of the disc. In use the work surface experiences an intermittent cutting or abrading action interspersed with non-abrading or non-cutting periods the spaced-apart groups being capable in use of aiding the movement of air about the working surface. In addition the removal of segments of the disc periphery aids in viewing the surface of a workpiece being abraded as the disc rotates.

The invention also comprises an abrasive tool provided with brush-like bristles which has a cup-shaped support with the bristles projecting in at least two spaced groups from around the rim of the cup.

Preferably the bristles are formed from metallic wire or the like, although optionally they may be made of some other substance such as hair, plastics, or the like. Also preferably the bristles are mounted in at least three spaced-apart groups. In some cases the bristles can be mounted in groups having a spiraling arrangement on the surface of a disc-shaped accessory, capable in use of aiding the movement of air over the surface of the accessory.

The tool is adapted for mounting upon the spindle or arbor of an angle grinder tool and for this purpose it is preferably provided with an optionally threaded central mounting aperture. The accessory may be a flat disc, or it may be a disc that is curved in cross-section like a saucer (and generally be used with the convex surface against the work), or it may have a deep, cup-like cross-section with the bristles extending substantially from the edge of the cup—and is used with the concave side toward the work.

In a preferred embodiment of the invention the tool is provided with a rest means having less effective abrading or cutting properties, located in fixed relation to the working zone of the tool and displaced from the working zone along the line of the axis of rotation of the tool and away from the grinder, so that in use an operator can rest the less effective rest means of the tool upon the work surface and then tilt the grinder about the tool so varying the angle of attack and thereby either increase or decrease the amount by which the working zone is impressed upon the work surface.

The working zone comprises a plurality of bristles capable of performing a cutting or abrading action when in rotational motion, the bristles projecting from the accessory in the working zone and the length of the bristles being such that at least a portion of the rest means can be contacted with a work surface with substantially no contact occurring between the bristles and the work surface. Preferably the bristles are located in a working zone which extends from the outer perimeter of the disk-shaped tool to a point that is up to two thirds, and more preferably up to one third, of the distance from the perimeter to the axis of rotation.

The tool preferably has a convex surface with the working zone provided by an outer peripheral portion of the convex surface of the disk having groups of bristles located thereon and in which the rest means is provided by a portion of the convex surface of the disc located radially inward of the working zone. However the rest means can be provided by an inner rest zone or protrusion that is not part of the disc such as a separately rotatable protrusion mounted by means of a bearing onto the tool or grinder spindle or a central protrusion built out from the body of the tool. Where the disc has a deep cup shape with the bristles projecting from the rim of the cup the rest means can be provided by a projection within the cup extending beyond the rim thereof. In use the bristles are moved outwardly by centrifugal force and by contact with the workpiece such that the rest means allows an abrasive contact of the bristles with the workpiece that is less effective than when the tool is rocked about the rest means to increase the pressure of contact between the bristles and the workpiece surface.

The tool is preferably provided with at least one aperture surrounded by the material of the disk between its first surface and its second surface, capable, when the tool is rotating, of admitting light so that a view of the work surface may be obtained, and of assisting in the admission of air into the region beneath the tool then over the work surface.

The segments of the body of the disc that are removed between the groups of bristles can have the form of chords removed from the periphery of the disc or alternatively they may be apertures open towards the periphery of the disk and forming a throat or an inwards digression of the edge of the disk. Optionally the or each such aperture can be formed with at least one edge of a substantially hard material thereby forming a cutting edge.

DESCRIPTION OF PREFERRED EMBODIMENTS

In the following passage a number of modified wire brushes that include one or more of the principles of the present invention. These are of course a set of non-limiting examples or preferred embodiments of the invention, and do not specify all possible variations.

DRAWINGS

FIG. 1: is a cross-sectional view of a concave disk-like tool according to the present invention.

Figure 2:
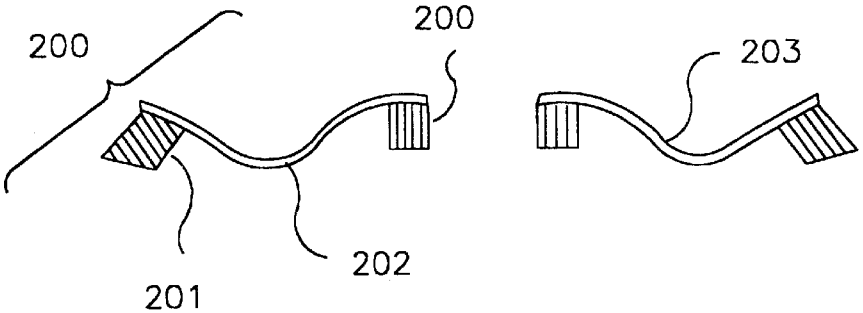

FIG. 2: is a cross-sectional view of a second tool according to the present invention.

Figure 4:
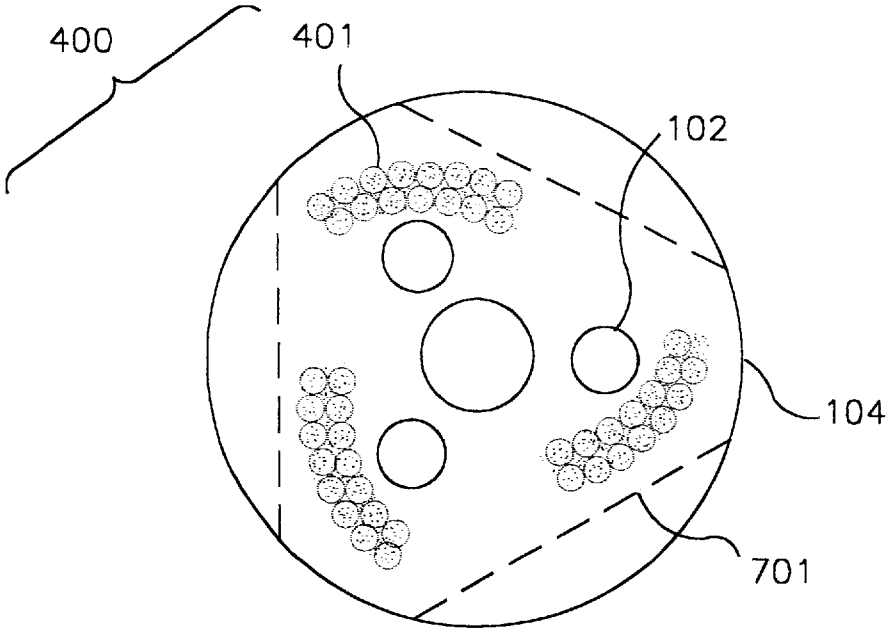

FIG. 4: is a plan view of a different tool, according to the invention.

Figure 5:
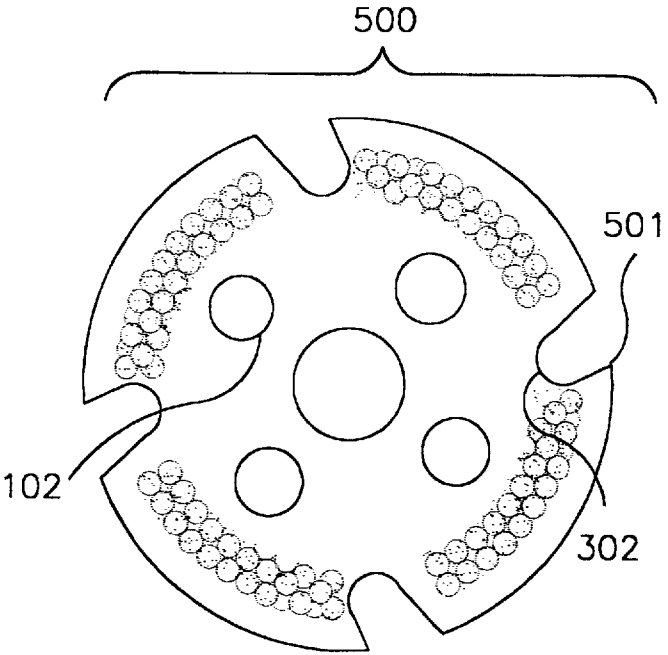

FIG. 5: is a plan view of another tool, according to the invention.

Figure 6:
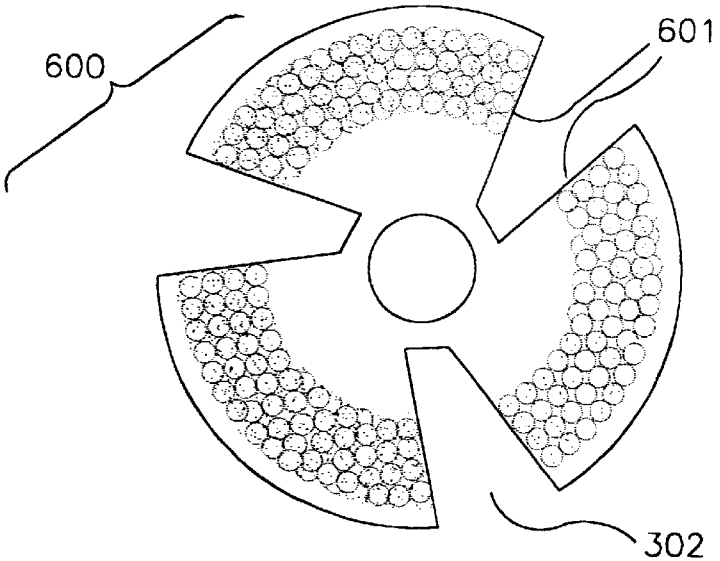

FIG. 6: is a plan view of a toothed tool, according to the invention.

Figure 7:
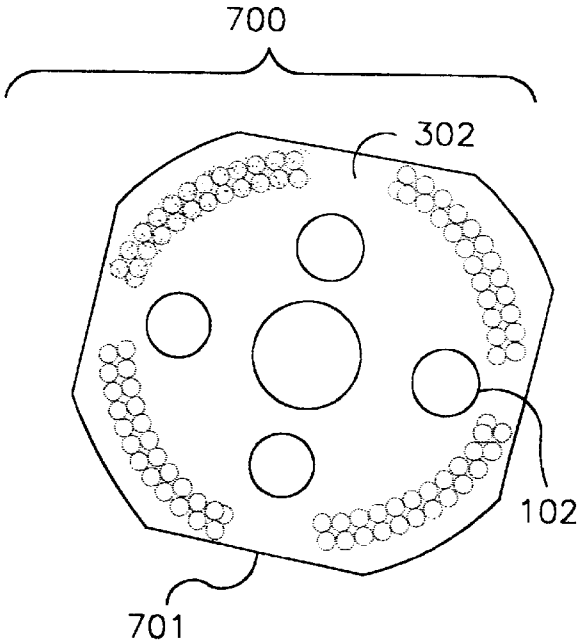

FIG. 7: is a plan view of a tool with sectors, according to the invention.

Figure 8:
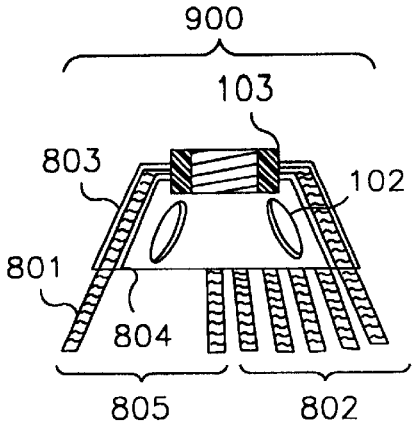

FIG. 8: is a side view of a cup-shaped tool , according to the invention.

Figure 9:
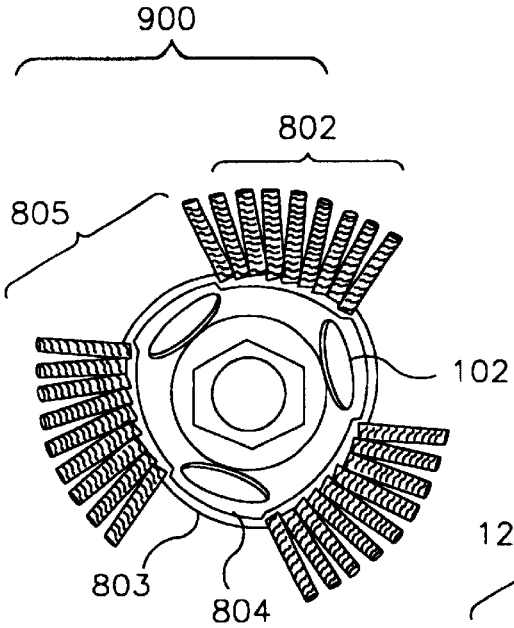

FIG. 9: is a plan view of a cup-shaped tool, according to the invention.

Figure 10:
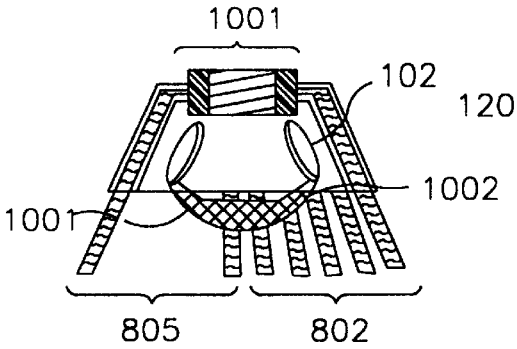

FIG. 10: is a side view of a cup-shaped tool with an internal spider, according to the invention.

Figure 11:
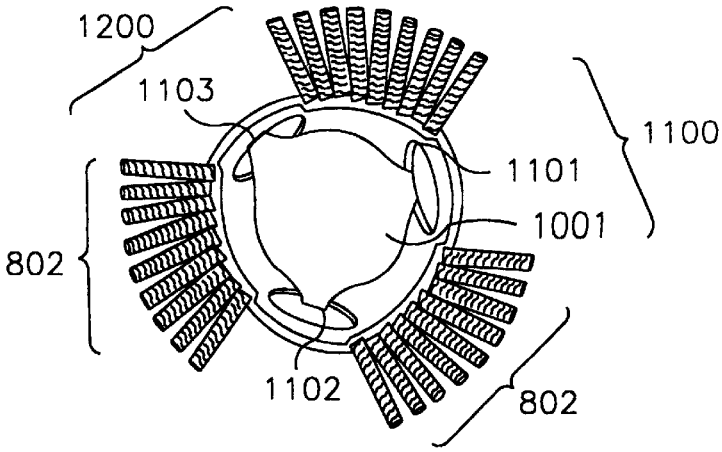

FIG. 11: is a side view of a cup-shaped tool with an internal spider, according to the invention.

Figure 12:
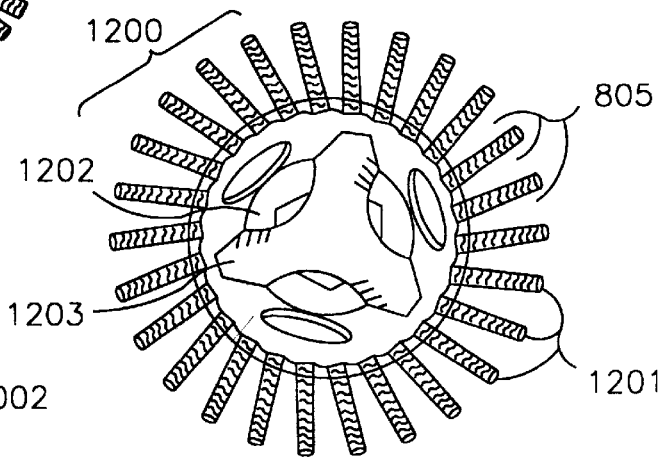

FIG. 12: is a side view of a cup-shaped tool having evenly spaced groups bristles, according to the invention.

Figure 14:
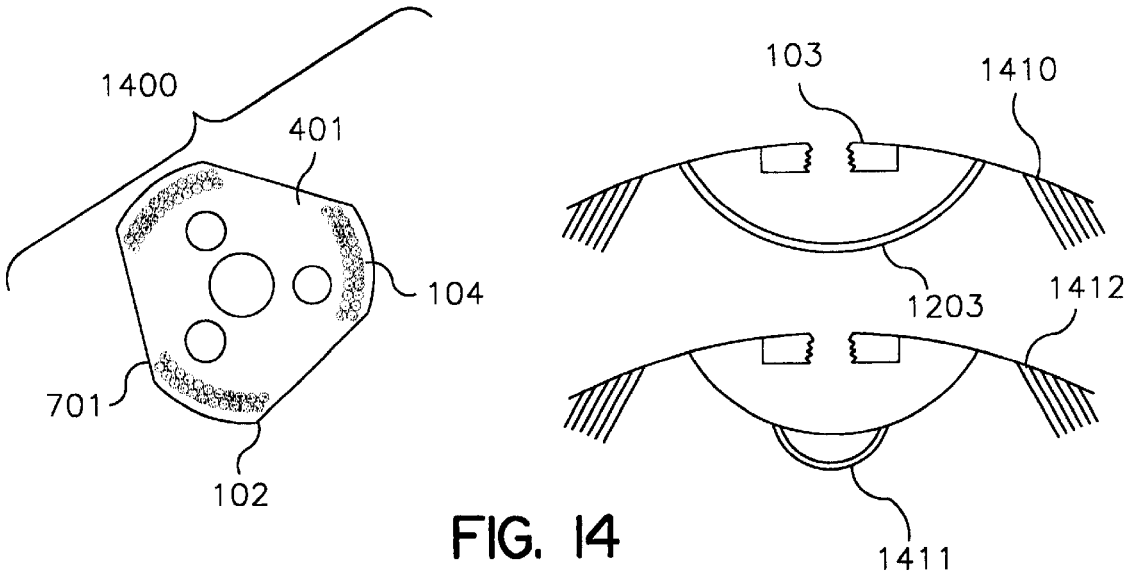

FIG. 14: is a side view of a trident-shaped tool having evenly spaced groups bristles, according to the invention along with sections through two alternatives for such a tool, having a central dome-like protrusion.

Figure 3:
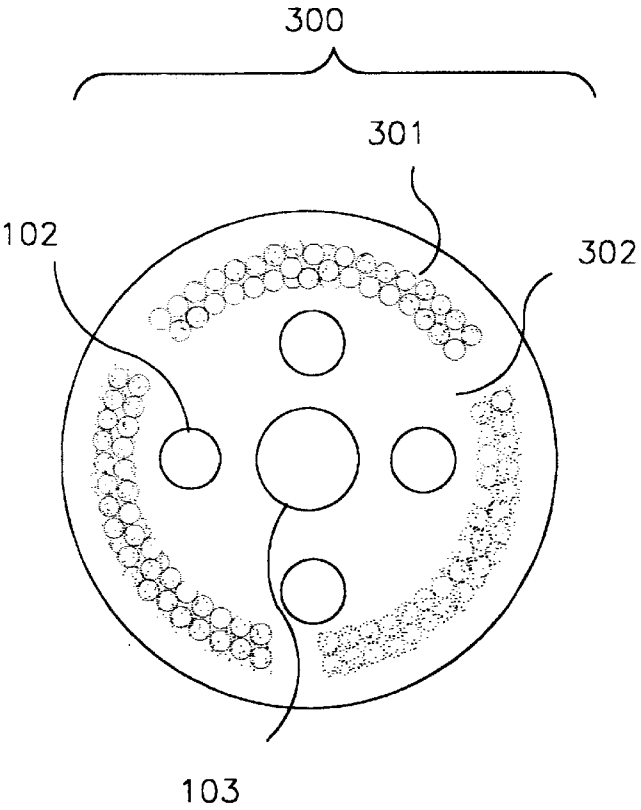
FIG. 3 PRIOR ART
Figure 13:
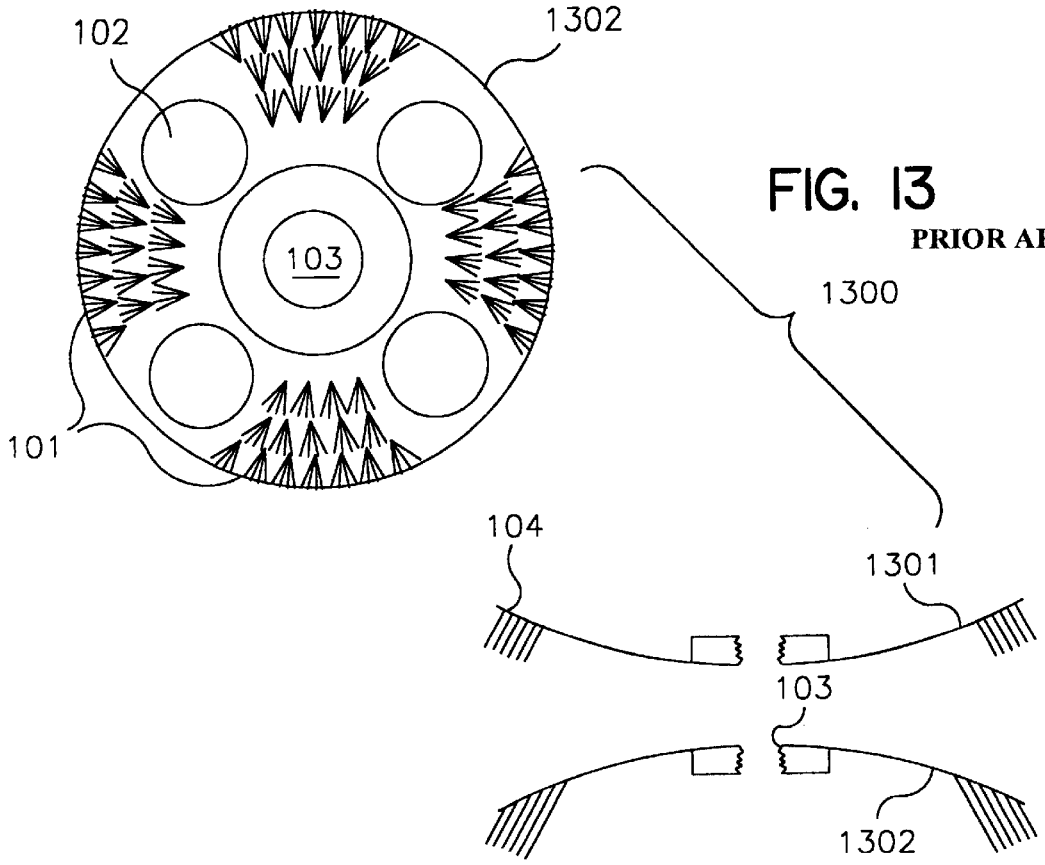
FIG. 13 PRIOR ART

FIGS. 3 and 13 illustrate structures described in PCT/US96/16511

Aspects of the shaping tools illustrated in the above Drawings include:

(a) viewing apertures 102 through which the work can be seen while being abraded, (b) rest means 202, 1001, 1411 (something to rest the spinning cutter on while tilting the angle grinder so as to more or less engage the working zone with the work surface), and (c) interruptions 302, 805 in the cutting/abrading areas that give an intermittent cutting/abrading action and appear to provide for cooling of the work surface during cutting.

It is commonly held in the trade that prior-art wire brush attachments, even a 3 inch diameter cup brush can in use "kill" angle grinders by imposing high torques. They are hard to control, because the operator has nothing with which to control the gradual introduction of the brush to the work surface. We have provided the grinding machine and brush-type shaping tool system with a rest means—comprising means to lean or rest the tool on the work surface, while in use, and from that leaning or rest point, the operator can gradually slope or incline the machine until the brushing face or edge of its disk starts to attack the work surface. Having established this angle or attitude, the machine may be slid or "stroked" preferably towards the operator; meanwhile the surface to be treated becomes visible through holes in the spinning disk. The rest means can be provided on the body of the angle grinder or as part of a guard beneath a portion of the wheel or on a rest point on the spinning disk, where it may form:

(a) A more central part of the disk—such as a domed or convex disk (FIG. 2), (b) An attached protrusion such as a concentric domed formation, spinning with the disk (FIGS. 1, 10, 11, 12, or 14) or (c) An attached though separately rotatable protrusion, such as a domed formation mounted by means of a bearing onto the disk or grinder spindle (not shown). This is commonly termed a "dead" guide.

FIGS. 1, 2 and 4 serve to introduce concepts of these wire brush tools. FIGS. I and 2 are median cross sections of two versions of a tool according to the invention. FIG. 4 shows the working surface of a disk, having several apertures 102, and groups of bristles 401 (here shown schematically as a pattern of arcs) which comprise a number of tufts of coarse wires or a larger number of tufts of finer wire, secured by gluing or more preferably by being passed through a metal disk, later concealed, the disk having many apertures for the purpose of retaining tufts or single wires bent into hairpin shapes. Note the bristles are shown here in three groups, separated by gaps. Preferably the number of groups is about three, but any number from one to at least 50 can be provided.

The apertures 102 allow for at least two things: viewing of the work surface by the operator and permitting the entry of air into the region beneath the spinning tool. Apertures in the tool disk are provided so that the user can see the material to be cut through the spinning blade as he/she is drawing the angle grinder and hence the working area towards himself/ herself. The apertures may be circular: a shape which has the advantages of being easy to drill and of minimizing comers where stress cracking may propagate, or may be of some other convenient shape, and may be cut straight through the material of the blade or may be raked in order to encourage the flow of air when spinning.

The arrangement of the arc-shaped bristle sectors in FIG. 4 like sections of a spiral may help in promoting the flow of air, inward through the apertures 102 and over the work surface, where the spiral arrangement of the bristles acts as an impeller. This arrangement of sectors gives the spinning tool a wider abrading area and it has an intermittent cutting/abrading action. The dotted line 701 indicates the segments removed from the periphery which have the shape of chords of the circular disc and which lead to the shape also shown in FIG. 14 (left side). These shapes allow for more tools to be made from a given area of sheet material and aid in edge visibility when spinning. (FIG. 7 shows a tool with four chords removed).

Holes of other than circular profile can easily be made by pressing or molding operations. Holes 12.5 to 24 mm. in diameter have been used in prototypes. Clearly, hole positions should be selected so as to retain the balance of the disc, and discs may be balanced dynamically by removing material from hole edges. Apertures need not be related to gaps between bristle sectors on a 1:1 basis. Any convenient number of gaps may be combined with any convenient number of apertures.

The apertures 102 may also aid in admitting air to the vicinity of the work surface for the purposes of cooling the work surface and the abrading bristles, and the flow of air carries any swarf, dust, scrapings, or the like to be ejected further from the tool, or ejected more effectively from the work area. To help in moving air the holes may be raked (drilled obliquely) or pitched. The trailing edges (in terms of the preferred direction of rotation) of one or more apertures may be shaped so that they can be used from time to time as cutting edges, by depressing them in the direction of the anticipated work material (that is, away from the body of the angle grinder) and preferably providing the edges with a hardening treatment.

In FIG. 1 a domed formation on the work surface side of the tool of FIG. I as 1001 provides a rest means on which the tool can be rested in contact with the work surface before the bristles (which, when spinning, are spread outwards or else become somewhat worn) touch the surface. This resting act could be performed before the motor is started but generally is done with the tool spinning. A variation 200 in FIG. 2 shows a stamped tool 203 where the surface 202 could be used as a rest surface.

A further addition to the family of wire-brush tools for an angle grinder is based on an existing tool bearing a continuous ring of bristles. With reference to the cup-like wire brush detailed in FIG. 12, a large number of sectors (approaching 50) may be provided by deleting every second tuft. This type is consistent with providing a viewing aperture and with providing intermittent cutting action.

The tool of FIG. 12 provides, like those of FIGS. 5, 6 and 7, gaps which provide both visibility and an intermittent cutting/abrading action. As a part of this feature, the gap between each tuft or sector of bristles appears to cause turbulent air movement between the individual sectors when spinning at the usual fast rate and this effect permits at least some cooling of the work surface and of the bristles during an abrasion procedure.

The relative angular size of the rest gaps 302 in relation to the angular size of the sectors may be varied. Reverting to FIG. 1, this shows a section of a saucer-shaped brush in which bristle tufts 101 project from the metal material 104 of the disk. The tufts may be bent, usually outward, and they may become bent outward when spinning or distorted during use. FIG. I provides rest means 1001 as does FIG. 2 at 202. These disks may be used with the grinder initially held with its motor/body almost parallel to the work, so that the rest means 202 rubs against the work. Tilting the grinder away from the work causes the bristles 201 to be engaged more and more. In contrast to previous wire brushes for angle grinders, this kind of wire brush does not have any "kick" if used with tilting, as described above. This type of tool can be made by pressing a steel disk 203 in a die, and attaching bristles.

FIG. 5 introduces a combination of cutting teeth 501 and a wire brush 500 as in FIG. 3. Note that the direction of rotation of the tool shown here is anti-clockwise. The cutting teeth, which may be made of hardened material such as tungsten carbide or may simply be hardened disk material, may be used by the operator from time to time (with the tool held at a steeper angle than usual) to attack a relatively brush-resistant protrusion from the work surface. Commonly the result of attacking a resistant object with a brush type of tool is that the softer surrounding surface is worn down too much. The teeth may also aid in air circulation. Preferably the borders of the teeth do not follow radius lines but are sloped or raked in the direction of rotation, thereby helping to throw out objects that may tend to catch in the teeth although that is unlikely at usual operating speeds.

FIG. 6 extends the apertures and teeth combined into deep throats 601, which interrupt the bristle array at 302 (as for FIG. 3) and provide improved visibility and air movement as well. These deep throats may be modifiable to act as surface shaving edges as well. Clearly, other arrangements of teeth and throats are also possible. A further addition to the tool described above comprises) comprises providing deep indentations into the body of the disk—past the radius occupied by the bristles and optionally provided also with viewing apertures. The deep indentations will also act as viewing apertures. These deep indentations are free of bristles. Typically three, but from two to twelve such throats may be provided. Of course, the bristles do not need to be continuous within the sectors—they may be spaced apart. The disturbance to air flow caused by the throats provides for intermittent cutting/abrading action, when air movement permits at least some cooling of the work surface during an abrasion procedure. It is possible to provide the edges of these throats with cutting edges so that the tool can be used as a combined cutter and wire brush.

FIG. 7 illustrates at 700 a different alteration to the disk edge. Here, four chord segments 701 have been removed. Note that the apertures 102 are in pairs at different distances from the tool centre. This extends the operator's view through a spinning tool; we have found it useful to see the work underneath the tool when in use. These segments may be considered as a corresponding number of shallow throats cut out of the edge. Again, these have the effect of increasing both air movement and visibility. From one to nine segments are preferred—if one; obviously balance should be preserved by compensation such as apertures elsewhere on the blade. Incidentally, blades in any of these examples can be provided as curved blades or as flat blades; the bristles or at least each tuft of bristles) may be of substantially a constant height above the blade or may be graded in height either with the longer bristles closer to the edge, or closer to the centre of the blade. Again, the bristles may be a continuous band or may be installed in sectors.

The devices illustrated in FIGS. 1 to 7 are shown as complete disk-like assemblies because the prior art (see FIG. 13) was made in this way. With reference to FIGS. 1 and 2, it is generally preferable to provide relatively long bristles because longer bristles flex more gradually than short bristles would, and should last longer before breaking. All of the bristles or wires which may be made of straight or crinkled (crimped) wire project to a height which is less than that of the rubbing surface. Note that in FIG. 2 the disk has a central "bare" zone which may be used as a rest in accordance with the principles of the invention for varying the angle of attack.

In addition, the leading edges of one or more perforations may be shaped as in FIG. 10 at 1003 so that they can act as gauges for nearby cutting edges 1004, by depressing them in the direction of the anticipated work material (that is, away from the body of the angle grinder) and preferably providing a hardening treatment. The perforations may advantageously be rectangular or even slot-shaped for cutting purposes, if this renders them easier to form. and to sharpen or re-sharpen.

Cup-shaped Wire Brush

Modifications to a standard cup-shaped wire brush, incorporating principles of the invention have been made as shown in FIGS. 8 to 12. In order to provide such a brush (see the section in FIG. 8-800) with the ability to provide an intermitt brush during manufacture by deleting selected tufts of wire so that the finished brush had three sectors 802 of wire, each separated by sectors 805 lacking wire. (The particular prior art model on which this embodiment is based has spiral wound tufts 801 of steel wire; each being bent in a 'U' shape and passed through a base web, which is later concealed, held, and made durable by being pressed between an inner cover 804 and an outer cover 803). The brush was further modified by drilling three 12.5 mm. holes, one through each of the pressed-together covers in each of the wire-free sectors. Thus we provided both an intermittent cutting/abrading action feature and an enhanced visibility feature in a brush which loads the angle grinder motor less yet retains a good cutting speed (see below). (103 is a conventional attachment nut).

FIG. 9 shows this brush from below. The three sectors having bristles 802 are shown, interspersed with three sectors having no bristles, as 805. The outer skin is shown as 803 and 804 represents the inner skin. In use, we observed that this modified brush removed material as quickly with a 2 lb pressure as did a conventional brush using a 3 lb pressure. An angle grinder using this brush also showed about 30% less power consumption. Another advantage of this configuration is seen during manufacture, where less materials are used, and the machine that threads the tufts through the retaining disk can be used to thread disks for two modified brushes at once—one overlying the other.

FIGS. 10, 11, and 12 show the cup-shaped wire brush of FIG. 8 further modified with rest means 1001 or 1203. FIG. 8 shows the rest means in cross-section. The rest means is provided in order to allow the angle of attack to be varied (in relation to the work surface). This is done by attaching a device 1001 (or 1203), herein called a "spider" inside the cup as shown in FIGS. 10 and 11. Preferably this device has a smooth relatively durable outer surface so that it can be rotated against the work surface without substantial abrasion. Preferably three, or more, legs 1002 are provided; each welded (or otherwise attached) to the inside of the cup as shown in FIG. 11. Three types of attachment are shown here; at 1103 a leg is welded to the work side of a viewing aperture, more preferably (as at 1101 or 1102) it is attached at the grinder side of a viewing aperture; either by welding 1101 or by bending a flange through the hole and back against the outer surface (as at 1102). The legs reach up to support a rounded or conical rubbing surface 1001 which may have a peak height about at half the length of the bristles. (That setting allows for (a) bristle wear, and (b) the tendency of bristles to be deflected outward when at an operating speed by centrifugal force).

In addition, the legs may be raked or twisted in a manner similar to that of a propeller in order to accentuate the flow of air onto the work surface when the tool is rotated in its preferred direction. The spider could alternatively be regarded as a propeller blade. The version included in FIG. 12 includes three raked edges, wherein the leading edges of the spider (as during rotation) are raked away from the work. This both assists in avoiding catching on a protrusion (generally a problem only at switching on) and in fanning air down on to the work; thereby assisting in cooling the work and the bristles.

The same angle of rake (which might for example be at about 25 degrees to the flat) also helps to avoid catching, a protruding object which might reach above the work surface. In use, the operator can hold the angle grinder with its motor axis about parallel to the work surface, with the centre of the spider rubbing on the work surface, and by tilting the wire brush while maintaining it in rubbing contact, the operator can progressively engage the bristles on the work surface with a closely controllable amount of force.

ADVANTAGES

Advantages of preferred forms of this invention include:

1. Material is removed quickly—removal speed is about twice as fast as a conventional wire brush on an angle grinder—other factors being equal.
2. There is little reaction or kickback against the too, reducing stresses on the operator. This helps to minimize the risk of exhaustion and errors which may be expensive and/or dangerous;
3. Control of the results is excellent, achieved by tilting (to vary the bite) and moving the tool over the work surface, while experiencing little kickback. The optional cutter teeth allow for specific attention to hard projections.
4. The user can see through perforations in the tool when spinning to accurately produce a desired conformation, or shape;
5. The work applied to the tool (ie. the power consumption of the grinder) is relatively low so that the revolutions do not drop as much as with prior-art brushes, and may be low enough to enable a rechargeable battery-operated grinder to be used
6. Less materials are used in making tools according to the invention than in making equivalent prior-art tools.

Finally, it will be appreciated that various alterations and modifications may be made to the shape of the cutter, the teeth, the materials used in constructions, without departing from the scope of this invention as set forth.

What is claimed is:

1. An accessory for a grinder comprising a rotatable disc-shaped tool having a circular perimeter adapted to be mounted on an arbor of a grinder and provided with a working zone extending inwardly from the perimeter of the tool which is provided with a plurality of bristles, wherein the bristles are mounted to project outwards from a surface of the tool in at least two spaced-apart groups around the working zone, and wherein the tool is also provided with apertures through the tool permitting vision of a workpiece surface during use and the perimeter of the tool is modified by removal of at least three spaced segments.

2. An accessory according to claim 1 wherein the segments removed from the perimeter of the tool are chord segments and number from 3 to 5.

3. An accessory according to claim 1 in which the bristles in each group are arranged in arcs each having a theoretical axis that is different from that of the disc.

4. An accessory according to claim 1 in which the segments removed from the perimeter of the tool provide a plurality of throats extending towards the axis of the tool.

5. An accessory according to claim 4 in which the throats separate adjacent groups of bristles.

6. An accessory according to claim 1 which is provided with a rest means extending about the axis of rotation of the tool and located inwardly of the working zone.

7. An accessory according to claim 6 in which the tool comprises a disc with a convex surface and the bristles project from a portion of the convex surface adjacent the perimeter which provides the working zone of the tool and the rest means is provided by the central portion of the convex surface.

8. An accessory for a grinder comprising a rotatable cup-shaped tool having abrading bristles projecting from the rim of the cup wherein the bristles are arranged in at least two spaced groups around the rim and the groups are separated by portions of the rim having no bristles and wherein a rest means projects from within the cup and extends beyond the rim of the cup, said rest means spaced from said brisles.

9. An accessory according to claim 8 in which the bristles are arranged in from 3 to 50 spaced groups around the periphery of the rim.

10. An accessory according to claim 8 in which the rest means is supported on legs having relatively flat surfaces angled with respect to the rotation of the accessory so as to accelerate the movement of air over the working surface when the accessory rotates.

11. An accessory according to claim 8 in which rest means is pierced by a plurality of apertures affording a view of the working surface when the accessory is in use.

* * * * *